US005137494A

United States Patent [19]

Schubert et al.

[11] Patent Number: 5,137,494

[45] Date of Patent: Aug. 11, 1992

[54] TWO-SIDED FORMS AND METHODS OF LAYING OUT, PRINTING AND FILLING OUT SAME

[76] Inventors: Keith E. Schubert, 4 Timothy Rd., W. Norwalk, Conn. 06850; Gerald E. Linden, 2261 Pimlico St., Orlando, Fla. 32822

[21] Appl. No.: 494,565

[22] Filed: Mar. 16, 1990

Related U.S. Application Data

[63] Continuation-in-part of Ser. No. 436,189, Nov. 13, 1989, which is a continuation-in-part of Ser. No. 334,183, Apr. 6, 1989.

[51] Int. Cl.[5] ..... B41L 1/20

[52] U.S. Cl. ..... 462/68; 462/66; 462/84; 503/205; 503/226

[58] Field of Search ..... 282/1 R, 2, 3 R, 8 R, 282/9 R, 11.5 A, 11.5 R, 12 R, 12 A, 15 B, 22 R, 27.5; 283/116; 503/205, 226; 462/66, 67, 68, 84

[56] References Cited

U.S. PATENT DOCUMENTS

| | | | |
|---|---|---|---|
| Re. 30,041 | 7/1979 | Maalouf | 282/27.5 |
| Re. 30,116 | 10/1979 | Maalouf | 282/27.5 |
| Re. 31,695 | 10/1984 | Zink | 427/211 |
| 371,126 | 10/1887 | Currie . | |
| 396,560 | 1/1889 | Harrison et al. . | |
| 418,455 | 12/1889 | Gray . | |
| 419,359 | 1/1890 | Rogers . | |
| 445,368 | 1/1891 | Campbell . | |
| 664,384 | 12/1900 | Cooke . | |
| 683,782 | 10/1901 | Morland . | |
| 756,258 | 4/1904 | Mallin . | |
| 765,408 | 7/1904 | Wildey . | |
| 797,302 | 8/1905 | Meacham . | |
| 897,783 | 9/1908 | Reynolds . | |
| 971,283 | 9/1910 | Krueger . | |
| 972,549 | 10/1910 | Lewis . | |
| 1,101,262 | 6/1914 | Edmonds . | |
| 1,187,686 | 6/1916 | Trueman | 282/12 |
| 1,301,834 | 4/1919 | Gilman . | |
| 1,392,748 | 10/1921 | Davidson . | |
| 1,468,094 | 9/1923 | Wherry . | |

(List continued on next page.)

FOREIGN PATENT DOCUMENTS

| | | |
|---|---|---|
| 549442 | 4/1932 | Fed. Rep. of Germany . |
| 613658 | 3/1926 | France . |
| 128558 | 2/1962 | New Zealand . |
| 128915 | 3/1964 | New Zealand . |
| 185282 | 11/1980 | New Zealand . |
| 1347807 | 2/1974 | United Kingdom . |
| 2085359 | 4/1982 | United Kingdom . |

OTHER PUBLICATIONS

Black Clawson Brochure.

"Flip-N-Rite", 7-page instructions by Gary Thompson.

FORM Magazine, Feb. 1989, pp. 74–80.

Business Forms Labels & Systems, Jul. 1990, p. 48.

"Pressure Sensitive Papers", Project 2558, No. 222, TAPPI Coating Committee 1965.

"Pressure Sensitive Papers", Project 2558, TAPPI Coating Committee, Dec. 1967.

Facsimiles of BH Medical, MAP Phone Message, Moore Two-Way Rite, St. Vincent Medical Center, Maybelline and Hartz Mountain forms.

*Primary Examiner*—Paul A. Bell

*Attorney, Agent, or Firm*—Gerald E. Linden

[57] ABSTRACT

Various configurations of "clear" areas for entering information on the front and back sides of an "original" page of a two-sided form are disclosed. The page may be the original page of a self-replicating form which includes a copy page and appropriate carbonless coatings. The clear area on the front side of the original page is offset from the clear area on the back side of the original page. A method for laying out the original page of the form, such as with a computer system, to ensure offset of the front and back clear areas, is also disclosed. A method of filling out "variable" information in the offset clear areas, such as with a computer system, is also disclosed.

12 Claims, 5 Drawing Sheets

U.S. PATENT DOCUMENTS

| | | | |
|---|---|---|---|
| 1,873,997 | 8/1932 | Davis . | |
| 1,980,318 | 11/1934 | Caton . | |
| 1,980,319 | 11/1934 | Caton . | |
| 2,006,034 | 6/1935 | Stevens . | |
| 2,035,768 | 3/1936 | Sherman et al. | 91/68 |
| 2,084,221 | 6/1937 | Schutz | 282/28 |
| 2,093,086 | 9/1937 | Luzzatto | 282/27 |
| 2,098,706 | 11/1937 | Lawson et al. | 282/12 |
| 2,118,888 | 5/1938 | Lewis et al. | 101/131 |
| 2,131,381 | 9/1938 | Linderman | 282/28 |
| 2,148,886 | 2/1939 | Wanser | 229/69 |
| 2,168,098 | 9/1939 | Groak | 282/26 |
| 2,194,670 | 3/1940 | Neu | 282/27 |
| 2,211,532 | 8/1940 | Biggs | 282/12 |
| 2,220,842 | 11/1940 | Hano | 282/12 |
| 2,226,722 | 12/1940 | Jones | 282/22 |
| 2,257,766 | 10/1941 | Sherman | 282/3 |
| 2,262,347 | 11/1941 | Sturc | 282/26 |
| 2,264,119 | 11/1941 | Lichter | 283/1 |
| 2,327,215 | 8/1943 | Potter | 282/12 |
| 2,458,729 | 1/1949 | Politzer | 40/102 |
| 2,470,586 | 5/1949 | Tathwell | 282/9 |
| 2,503,680 | 4/1950 | Newman | 282/19 |
| 2,548,366 | 4/1951 | Green et al. | 282/28 |
| 2,550,466 | 4/1951 | Green et al. | 282/28 |
| 2,550,468 | 4/1951 | Green et al. | 282/28 |
| 2,550,469 | 4/1951 | Green et al. | 282/28 |
| 2,606,775 | 8/1952 | Newman | 282/28 |
| 2,618,573 | 11/1952 | Green | 117/36 |
| 2,637,571 | 5/1953 | Tilly | 281/5 |
| 2,694,429 | 11/1954 | Berger | 150/39 |
| 2,712,507 | 7/1955 | Green | 117/36 |
| 2,802,678 | 8/1957 | Bright | 282/22 |
| 2,869,898 | 1/1959 | Martin . | |
| 2,870,040 | 1/1959 | Gill | 117/36 |
| 2,907,585 | 10/1959 | Sornberger | 282/22 |
| 2,980,447 | 4/1961 | Weger | 282/22 |
| 3,016,308 | 1/1962 | Macaulay | 117/36.7 |
| 3,104,799 | 9/1963 | Steidinger | 229/69 |
| 3,364,052 | 1/1968 | Martino | 117/15 |
| 3,376,154 | 4/1968 | Campbell et al. | 117/364 |
| 3,429,827 | 2/1969 | Ruus | 252/316 |
| 3,481,759 | 12/1969 | Ostlie | 117/36.2 |
| 3,539,375 | 11/1970 | Baum | 117/36.2 |
| 3,625,547 | 12/1971 | Burke | 282/23 |
| 3,682,681 | 8/1972 | Kunkel | 503/205 |
| 3,769,057 | 10/1973 | Lin | 117/36.2 |
| 3,769,062 | 10/1973 | Ishige et al. | 117/36.2 |
| 3,825,467 | 7/1974 | Phillips, Jr. | 161/159 |
| 3,854,654 | 12/1974 | Van Malderghem | 229/69 |
| 3,902,655 | 9/1975 | Huffman | 229/69 |
| 3,908,063 | 9/1975 | Rosendale et al. | 428/320 |
| 3,945,870 | 3/1976 | Johnsen | 156/201 |
| 3,955,750 | 5/1976 | Huffman | 229/69 |
| 3,963,853 | 6/1976 | Hughes et al. | 428/326 |
| 3,968,299 | 7/1976 | Angleman | 503/226 X |
| 3,981,523 | 9/1976 | Maalouf | 282/27.5 |
| 3,988,971 | 11/1976 | Steidinger | 93/63 M |
| 3,996,406 | 12/1976 | Alsop | 428/307 |
| 4,000,916 | 1/1977 | Lucas | 282/11.5 |
| 4,036,511 | 7/1977 | Maalouf | 282/27.5 |
| 4,039,046 | 7/1977 | D'Luhy | 282/22 R |
| 4,045,053 | 8/1977 | Carriere | 282/22 R |
| 4,046,404 | 9/1977 | Treier | 282/27.5 |
| 4,056,191 | 11/1977 | Weisenfluh | 206/629 |
| 4,062,567 | 12/1977 | Macaulay | 282/27.5 |
| 4,063,754 | 12/1977 | Shackle et al. | 282/27.5 |
| 4,081,127 | 3/1978 | Steidinger | 229/69 |
| 4,081,188 | 3/1978 | Westcott | 282/27.5 |
| 4,091,122 | 5/1978 | Davis et al. | 427/44 |
| 4,095,695 | 6/1978 | Steidinger | 206/620 |
| 4,097,619 | 6/1978 | Davis et al. | 427/44 |
| 4,111,461 | 9/1978 | Levensalor | 282/27.5 |
| 4,112,138 | 9/1978 | Davis et al. | 427/54 |
| 4,113,281 | 9/1978 | Halse | 282/11.5 A |
| 4,121,857 | 10/1978 | Halse | 282/11.5 A |
| 4,126,334 | 11/1978 | Van Malderghem | 282/22 R |
| 4,137,343 | 1/1979 | Davis et al. | 427/150 |
| 4,138,302 | 2/1979 | D'Luhy | 156/216 |
| 4,139,218 | 2/1979 | Davis et al. | 282/27.5 |
| 4,139,392 | 2/1979 | Davis et al. | 106/14.5 |
| 4,143,890 | 3/1979 | Davis et al. | 282/27.5 |
| 4,143,891 | 3/1979 | Neubauer | 282/27.5 |
| 4,165,101 | 8/1979 | Sternberg | 283/116 X |
| 4,168,851 | 9/1979 | Halse | 282/11.5 A |
| 4,172,605 | 10/1979 | Welsch et al. | 282/27.5 |
| 4,178,018 | 12/1979 | Halse | 282/11.5 A |

(List continued on next page.)

U.S. PATENT DOCUMENTS

| | | | |
|---|---|---|---|
| 4,198,446 | 4/1980 | Goetz | 427/150 |
| 4,199,174 | 4/1980 | Sornberger | 282/27.5 |
| 4,203,619 | 5/1980 | Sanders | 282/27.5 |
| 4,208,460 | 6/1980 | Knechtle et al. | 428/195 |
| 4,217,162 | 8/1980 | Glanz et al. | 156/305 |
| 4,282,275 | 8/1981 | Werner | 427/428 |
| 4,336,067 | 6/1982 | Shackle et al. | 106/21 |
| 4,343,494 | 8/1982 | Ehrhardt et al. | 282/27.5 |
| 4,352,855 | 10/1982 | Hiraishi et al. | 428/320.4 |
| 4,354,449 | 10/1982 | Zink | 118/126 |
| 4,361,108 | 11/1982 | Robillard et al. | 118/265 |
| 4,381,120 | 4/1983 | Golden | 282/27.5 |
| 4,397,483 | 8/1983 | Hiraishi et al. | 282/27.5 |
| 4,407,524 | 10/1983 | Trautlein | 282/9 R |
| 4,425,386 | 1/1984 | Chang | 427/256 |
| 4,448,445 | 5/1984 | Chang et al. | 346/206 |
| 4,455,327 | 6/1984 | Yoshida et al. | 427/131 |
| 4,501,559 | 2/1985 | Griswold et al. | 434/154 |
| 4,512,595 | 4/1985 | Breen | 283/70 |
| 4,533,160 | 8/1985 | Malone | 282/23 R |
| 4,556,390 | 12/1985 | Rahn et al. | 434/433 |
| 4,566,720 | 1/1986 | Goldman et al. | 281/15 R |
| 4,576,399 | 3/1986 | White et al. | 282/8 R |
| 4,583,765 | 4/1986 | Messinger | 282/9 R |
| 4,593,935 | 6/1986 | Kearns | 282/28 R |
| 4,597,993 | 7/1986 | Okada et al. | 427/150 |
| 4,614,362 | 9/1986 | Breen et al. | 282/9 R |
| 4,614,363 | 9/1986 | Breen | 282/22 R |
| 4,636,818 | 1/1987 | Jerabek | 346/213 |
| 4,642,662 | 2/1987 | Torii et al. | 346/215 |
| 4,657,783 | 4/1987 | Tatt et al. | 427/211 |
| 4,690,433 | 9/1987 | Showers et al. | 283/1 |
| 4,715,620 | 12/1987 | Thompson | 282/9 R |
| 4,722,553 | 2/1988 | Evans | 282/9 R |
| 4,740,015 | 4/1988 | Caprio et al. | 283/70 |
| 4,745,097 | 5/1988 | Maekawa et al. | 503/209 |
| 4,762,342 | 8/1988 | Thompson | 282/9 R |
| 4,814,319 | 3/1989 | Matsumoto et al. | 503/216 |
| 4,846,594 | 7/1989 | Riskin | 400/188 |
| 4,853,364 | 8/1989 | Liang et al. | 503/216 |
| 4,859,561 | 8/1989 | Metz et al. | 430/138 |
| 4,871,193 | 10/1989 | Wörndli | 283/72 |
| 4,877,767 | 10/1989 | Liang et al. | 503/212 |
| 4,912,080 | 3/1990 | Weinstein | 503/200 |
| 4,935,401 | 6/1990 | Pendergrass, Jr. | 503/206 |
| 4,938,507 | 7/1990 | Ashby et al. | 282/9 R |
| 4,947,343 | 7/1990 | Amari | 364/518 |
| 4,957,380 | 9/1990 | Gerstle et al. | 400/279 |
| 4,959,343 | 9/1990 | Weinstein | 503/200 |
| 4,970,193 | 11/1990 | Liang et al. | 503/201 |
| 4,974,035 | 11/1990 | Rabb et al. | 355/320 |
| 4,977,060 | 12/1990 | Liang et al. | 430/138 |
| 4,977,131 | 12/1990 | Macaulay | 503/201 |
| 4,996,184 | 2/1991 | Bevan et al. | 503/226 |
| 5,002,311 | 3/1991 | Brunjes | 282/9 R |
| 5,004,271 | 4/1991 | Piatt | 283/65 |

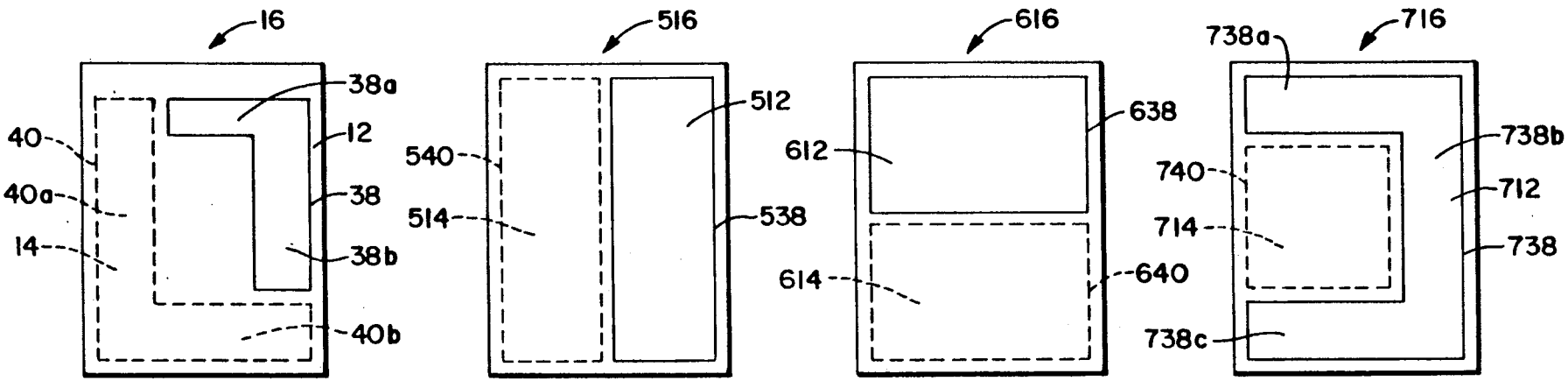
FIG. 4
FIG. 5
FIG. 6
FIG. 7
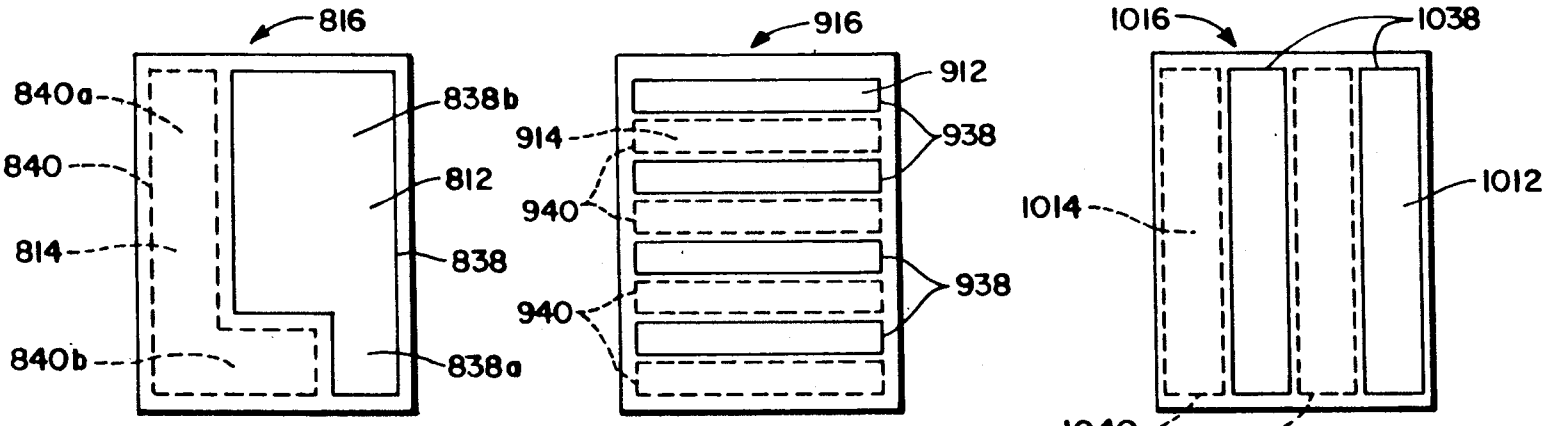
FIG. 8
FIG. 9
FIG. 10

TWO-SIDED FORMS AND METHODS OF LAYING OUT, PRINTING AND FILLING OUT SAME

CROSS REFERENCE TO RELATED APPLICATIONS

This is a continuation-in-part of copending U.S. Pat. application No. 436,189, entitled filed Nov. 13, 1989 by Keith E. Schubert, which is a continuation-in-part of copending U.S. patent application No. 334,183, entitled filed Apr. 6, 1989 by Keith E. Schubert.

Reference is made to copending U.S. patent application No. 07/484,686, entitled FORM FOR MAKING TWO-SIDED CARBONLESS COPIES OF INFORMATION ENTERED ON BOTH SIDES OF AN ORIGINAL SHEET AND METHOD OF EMPLOYING SAME, filed by Keith E. Schubert on Feb. 23, 1990.

TECHNICAL FIELD OF THE INVENTION

The invention relates to laying out (formatting) two-sided forms and controlling the entering of information on both sides of the form and, more particularly, to formatting and entering information on both sides of a carbonless form that creates a two-sided copy of a two-sided original.

BACKGROUND OF THE INVENTION

Billions of two-sided forms are used every year, ranging from tax forms to insurance forms to accident report forms and the like. Heretofore, there has not been a satisfactory technique for producing an instant, carbonless copy of these forms for retention by the user.

Copending U.S. patent application No. 436,189, entitled filed Nov. 13, 1989 by Keith E. Schubert and copending U.S. patent application No. 334,183, entitled filed Apr. 6, 1989 by Keith E. Schubert disclose techniques for reproducing on two sides of a copy page information entered on both sides of an original page (form). In an exemplary embodiment of this technology, carbonless CB coating is applied to a selected area of the front side (Side 1) of an original sheet, and the remaining area is clear of coating. In the clear area, "variable" information is entered, such as by hand (writing) or by computer (impact) printing, and is reproduced on one side (Side 1) of a copy sheet. This occurs by the coreaction of a CB coating on the back (Side 2) of the original sheet, in an area aligned front-to-back with the clear area on the front of the original sheet, and a corresponding carbonless CF coated area on the back (Side 1) of the copy sheet. In a similar manner, "variable" information entered in a clear area on the back side (Side 2) of the original sheet is reproduced on a CF coated area on the other side (Side 2) of the copy sheet. The clear area on the front of the original sheet is offset (not in front-to-back alignment) from the clear area on the back of the original sheet, and it is in these offset clear areas that the information is entered. Other, "fixed", generally preprinted information, such as instructional information, appears on the forms to prompt the user to fill in the appropriate variable information in the clear areas.

Several software packages are on the market which are used for designing forms. Other software packages are used for filling in the variable information on forms. In the context of two-sided forms which have offset (from one side to the other) areas for entering information on both sides thereof, what is needed is a methodology for ensuring (in the forms design process) that the areas for the user entering variable information on the form are offset from front-to-back on the form (original page), and for ensuring that the variable information that is entered on the form is offset from front-to-back on the form when the form is filled out by a computer.

Further, what is needed are standardized patterns for laying out the offset clear areas.

The subject of the present application is effecting control over the design and imprinting of two-sided forms that will achieve the desired offset, or nonalignment of information entered on the front and back of the form. This will be very important to forms designers and users, particularly those using computer-based forms layout and fill-out systems.

U.S. Pat. No. 4,846,594, entitled APPARATUS FOR PRINTING OF ENVELOPES AND PRE-PACKAGED MAILING INSERTS discloses printing within selected areas both on the reverse and obverse sides of an insert (page) contained within an envelope. The inside of the front envelope surface is provided with alternating first inking strips and first intervening blank strips. Similarly, the inside of the back envelope surface is provided with alternating second inking strips and intervening second blank strips. The first inking strips on the front envelope surface are aligned with the intervening second blank strips on the back envelope surface, and the second inking strips on the back envelope surface are aligned with the intervening first blank strips on the front envelope surface. In this manner, when a printer impacts the outside of the front envelope surface in an area corresponding to the first inking strips, printing is transferred via the first inking strips to one side of the insert. When the printer impacts the outside of the front envelope surface in an area corresponding to the intervening first blank strips, printing is transferred via the second inking strips to the other side of the insert (by reverse print characters). This patent is limited in its utility by the line-by-line, front-to-back printing approach, with its intervening blank spaces (strips) on each side of the insert. What purports to be a technique for doubling the total amount of information contained on the insert, in reality, simply accommodates the same amount of information in double-spaced format on both sides of the insert that could be achieved with single-spaced format on only one side of the insert. Further, it is restricted to using the front and back surfaces of the envelope, with opaque carbonized stripes, to fill out the insert.

DISCLOSURE OF THE INVENTION

It is therefore an object of the present invention to provide standardized patterns for the clear areas of two-sided forms having selected clear areas on the front and back sides thereof for filling in variable information.

It is a further object to provide a method of designing two-sided forms so that the selected clear areas for filling in variable information are offset from front-to-back on the form.

It is a further object to provide a method of filling in variable information on two-sided forms so that the information is entered in the offset clear areas.

According to the invention, a form layout system defines "clear" areas for entering "variable" information on the front and back sides of a page. The areas for entering the variable information are offset, or non-aligned from the front to the back of the page.

According to an aspect of the invention, forms layout software checks the location of clear areas for entering information on one side of the page and ensures that they are offset front-to-back from clear areas for entering information on the other side of the page. It is acceptable that "fixed", such as preprinted information on both sides of the form is aligned (not offset) from front-to-back on the page, so long as the user-entered ("variable") information is offset in the clear areas.

Further according to the invention, forms filling-out software is configured to enter the variable (user-specific) information in the clear areas which are offset from front-to-back on a two-sided form.

Further according to the invention, there are provided various formats for defining the layout of the clear areas on both sides of the original page of a two-sided form, wherein the clear areas on the front side (Side 1) of the page are offset, front-to-back on the page, from the clear areas on the back side (Side 2) of the page.

Other objects, features and advantages of the invention will become apparent in light of the following description thereof.

BRIEF DESCRIPTION OF THE DRAWINGS

FIG. 1A is a top, plan view of a carbonless copy form, according to U.S. patent application No. 436,189.

FIG. 1B is a bottom view of the form of FIG. 1A.

FIG. 1C is a cross sectional view of the form of FIG. 1A.

FIG. 1D is a perspective view of the form of FIG. 1A, folded one way with the original and copy pages in back-to-back relationship for filling out variable information on the front of the original page.

FIG. 1E is a perspective view of the form of FIG. 1A, folded another way with the original and copy pages in front-to-front relationship for filling out variable information on the back of the original page.

FIG. 2 is a schematic of a computer system for laying out and filling out two-side forms.

FIG. 3A is a flowchart of a subroutine for the forms layout system of FIG. 2.

FIG. 3 is a view of a screen display for the system of FIG. 2.

FIGS. 4-10

FIG. 4 is a plan view of a two-sided form having offset clear areas for entering variable information on the front and back sides thereof, according to the aforementioned U.S. patent application No. 436,189.

FIG. 5 is a plan view of a two-sided form having an alternate configuration of offset clear area for entering variable information on the front and back sides thereof.

FIG. 6 is a plan view of a two-sided form having an alternate configuration of offset clear area for entering variable information on the front and back sides thereof.

FIG. 7 is a plan view of a two-sided form having an alternate configuration of offset clear area for entering variable information on the front and back sides thereof.

FIG. 8 is a plan view of a two-sided form having an alternate configuration of offset clear areas for entering variable information on the front and back sides thereof.

FIG. 9 is a plan view of a two-sided form having an alternate configuration of offset clear areas for entering variable information on the front and back sides thereof.

FIG. 10 is a plan view of a two-sided form having an alternate configuration of offset clear areas for entering variable information on the front and back sides thereof.

Throughout the FIGS. #12 is the front side (Side 1) of the page (16), #14 is the back side (Side 2) of the page (16), #16 is the original page of a two-sided form, #38 is a clear area for entering variable information on the front side of the page and #40 is a clear area for entering variable information on the back side of the page, where "#" is an integer between zero and ten. The terms "front", "back", "top", "bottom", "right" and "left" are exemplary.

DETAILED DESCRIPTION OF THE INVENTION

Figure 1A:
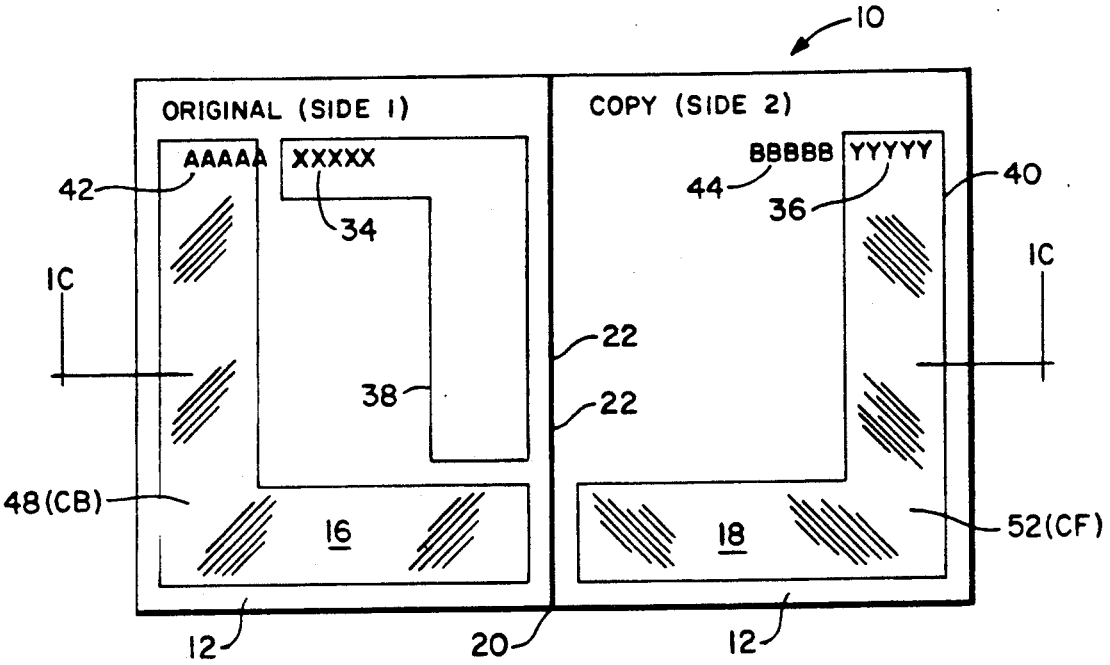
FIGS. 1A-1E
Figure 1B:
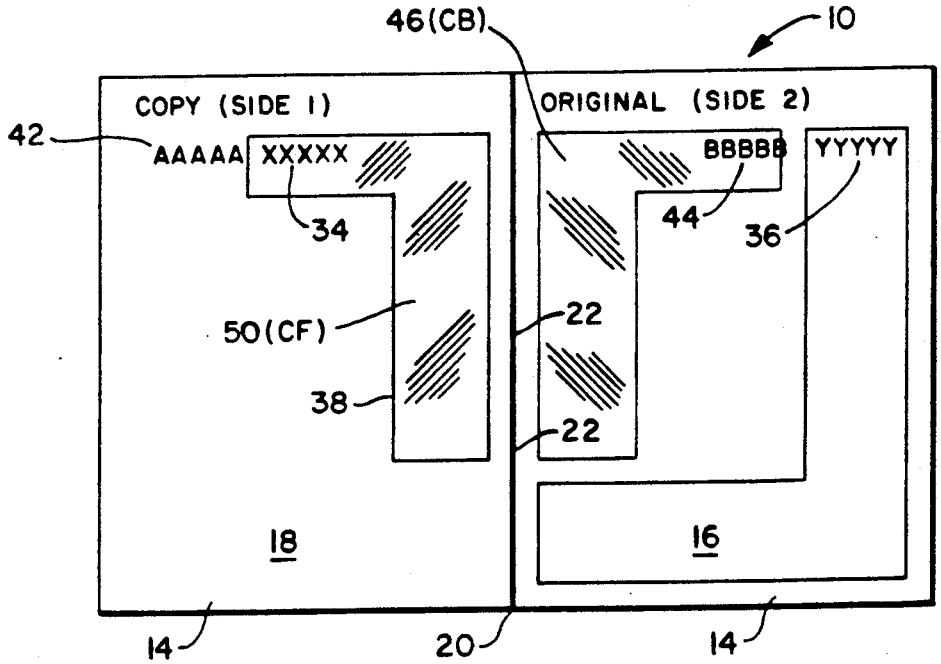
Figure 1D:
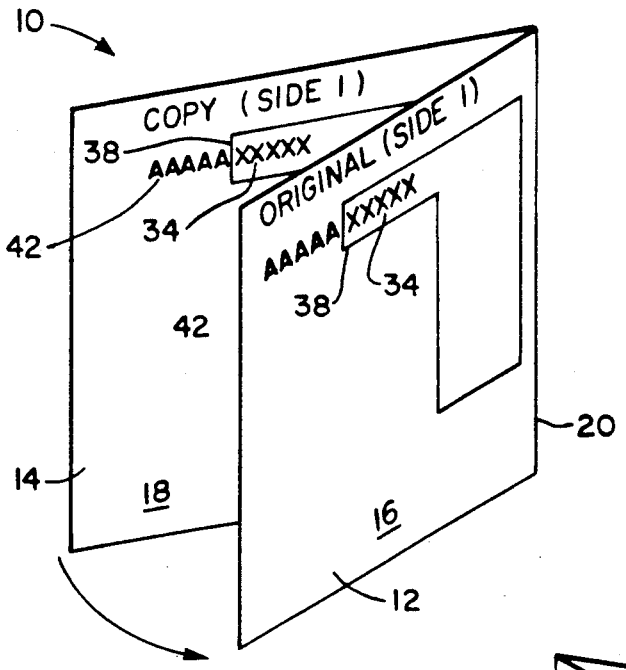
Figure 1E:
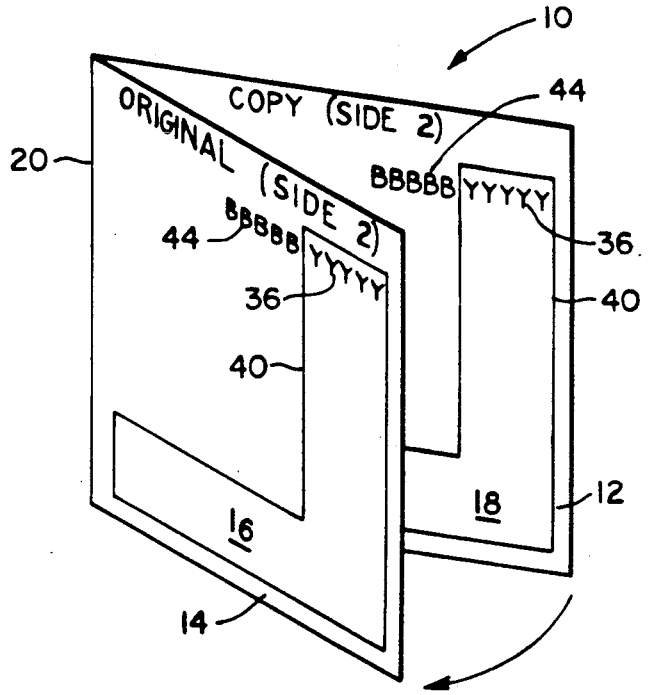
Figure 1C:
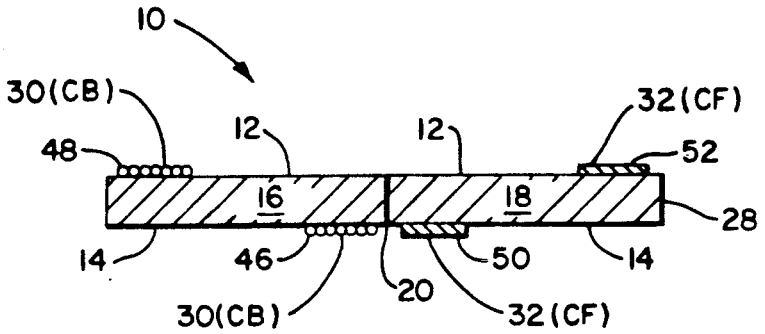

FIGS. 1A, 1B and 1C

FIGS. 1A-1E show an embodiment of a carbonless copy form 10, as disclosed in the aforementioned U.S. patent application No. 436,189. A single sheet 10, having a front surface 12 and a back surface 14, is divided by a boundary 20, having perforations 22, into an original page 16 and a copy 18.

A selected area 38 is shown for entering first "variable" information 34 ("XXXXX") on the front side 12 of the original page 16. The area 38 does not necessarily include the preprinted inverted L-shaped border, which is included for illustrative purposes.

A selected area 40 is shown for entering second "variable" information 36 ("YYYYY") on the back surface 14 of the original page 16, and does not necessarily include the illustrated L-shaped preprinted border.

Legends 42 ("AAAAA") and 44 ("BBBBB") are preprinted (with fixed information) adjacent to the selected areas 38 and 40, respectively, for entering information on the front and back 12 and 14, respectively, of the original page 16, and are repeated on the copy page 18. These legends are preprinted on the form and represent "fixed" information which directs the user to fill in the "variable" information 34 and 36.

It is significant that the first and second selected areas 38 and 40 for entering variable information 34 and 36, respectively, are offset, in other words they are not in front-to-back alignment with each other. This is because selected other areas 46 and 48 on the original page are coated with a carbonless CB treatment 30 for reproducing (variable) information 34 and 36 entered on the front and back of the original page 16 onto the back and front of the copy page 18.

The CB-coated area 46 is positioned on the backside 14 of the original page 16, in alignment with the clear area 38 on the front of the original page. A corresponding area 50 on the back side 14 of the copy page 18 is coated with carbonless CB treatment 30. In this manner, information entered by the user ("variable" information) on the front side 12 of the original page 16 in the "clear" area 38 will be reproduced, when the original and copy pages are folded in back-to-back relationship (as shown in FIG. 1D), on the CF-coated area 50 on the back 14 of the copy page 18.

The CB-coated area 48 is positioned on the front side 12 of the original page 16, in alignment with the clear area 40 on the back side of the original page. A corresponding area 52 on the front side of the copy page 18 is coated with carbonless CF treatment 32. In this manner, information entered by the user ("variable" information) on the backside 14 of the original page 16 in the "clear" area 40 will be reproduced, when the original and copy pages are folded in front-to-front relationship (as shown in FIG. 1E), on the CF-coated area 52 on the front 12 of the copy page 18.

This generally describes the context of two-sided carbonless copying, wherein selected "clear" areas on the front and back of the original page are offset (not in front-to-back alignment on the original page) for the purpose of entering variable (versus preprinted) information in those clear (of carbonless coating) areas. A more detailed description of this technology appears in the aforementioned U.S. patent application No. 436,189.

The selective application of carbonless CB and CF copy treatments only to selected area of a sheet of paper is well within the grasp of one skilled in the art to which this invention most nearly pertains, and is usually termed "patterning", or "spot" application of coatings.

It is within the scope of the invention that separate (non-joined) original and copy pages can be provided, but the formation of original and copy pages from a single sheet of paper is advantageously self-aligning.

Throughout the various embodiments described herein, it should be appreciated that the carbonless coatings have been enormously exaggerated for illustrative purposes.

It is further noted that the selected clear areas for entering variable information on the front and back sides of the original page, although offset, can occupy up to 100%, in aggregate, of the surface are of the original page, e.g. 93.5 square inches for an 8½ by 11 inch page. The "fixed" information can occupy the remaining 93.5 square inches available on the front and back sides of the original page. Hence, the entire front and back surfaces of the original page can be utilized for doubling the total amount of information contained on the page which, after all, is the main object of having a two-sided form. This a significant achievement, even in light of the aforementioned U.S. Pat. No. 4,846,594.

It is further noted that it is not necessary that the preprinted information (e.g., 42 and 44) does not need to be offset from the front to the back of the page, since this information is typically printed on the pages without the pages being folded, for reproducing the variable information entered on the front and back of the original page.

Figure 2:
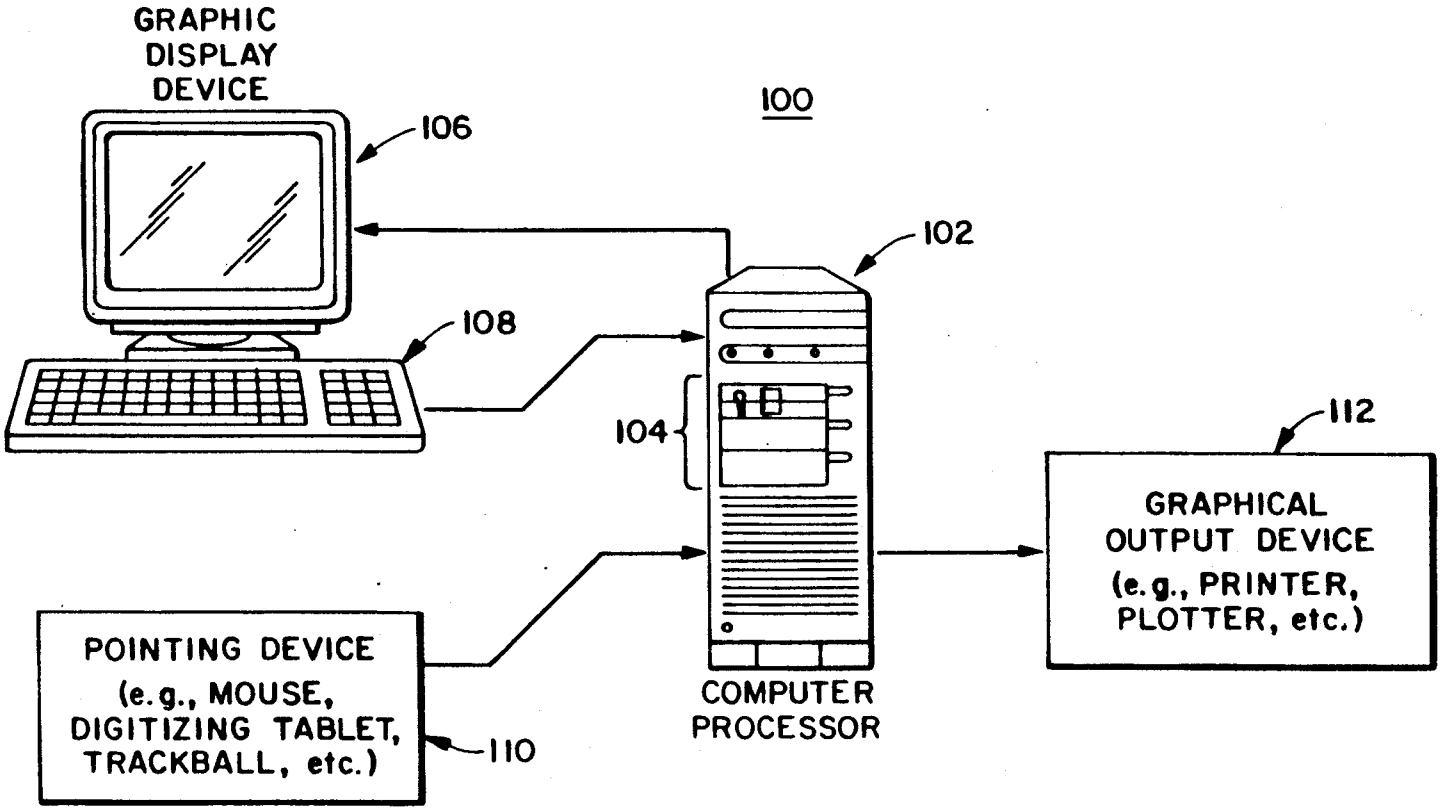
FIGS. 2, 3A and 3B
Figure 3B:
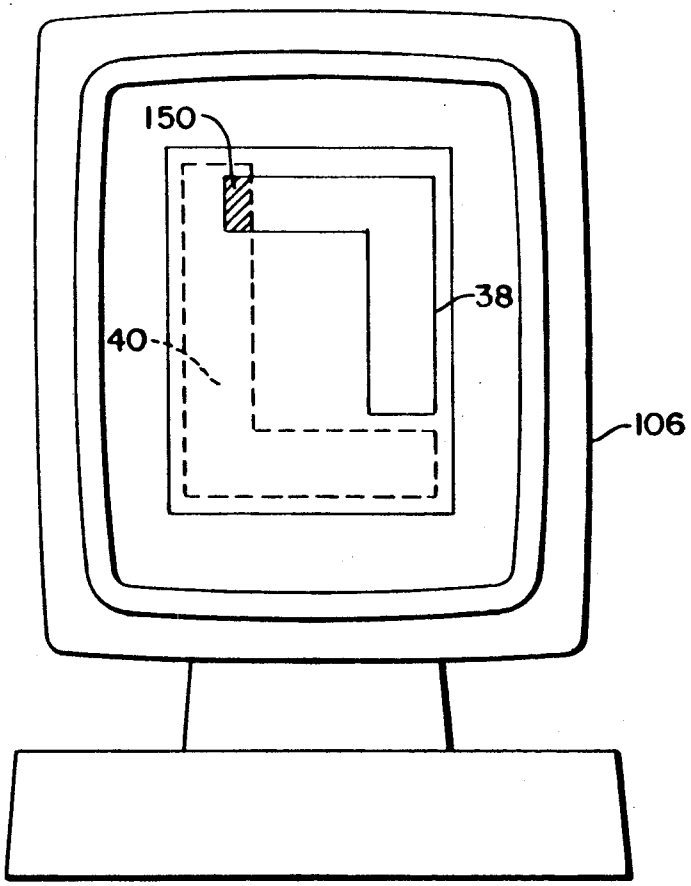
Figure 3A:
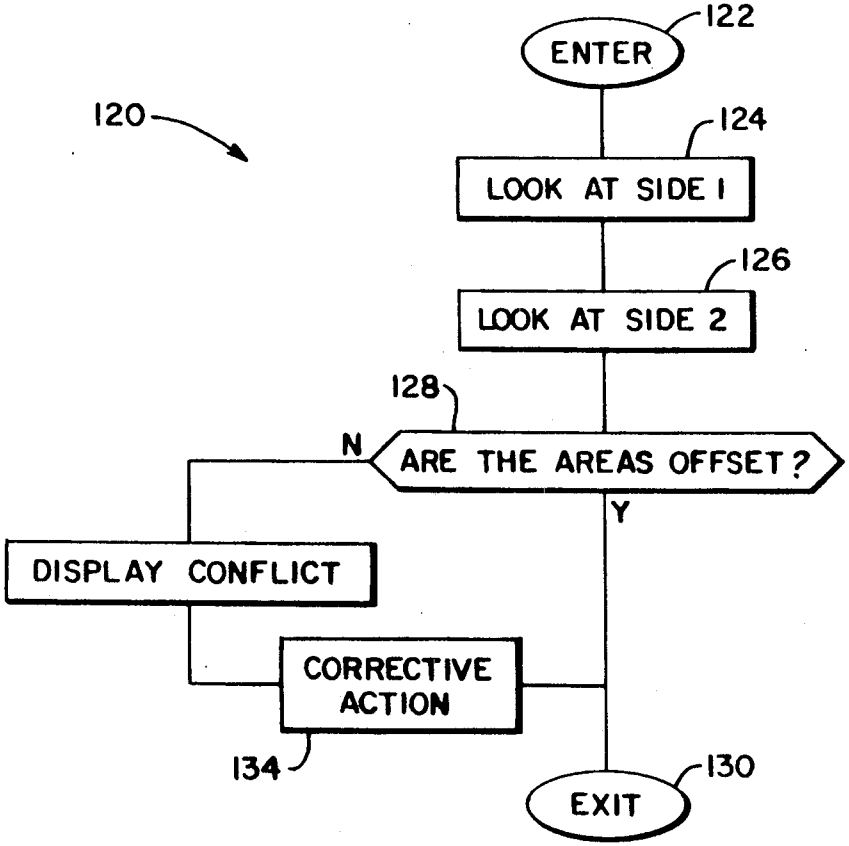

FIGS. 2, 3A and 3B

FIG. 2 shows apparatus for laying out clear areas for entering variable information on a two-sided form and for filling out the variable information on the form. FIG. 3A shows a flowchart of a method of operating the apparatus.

FIG. 2 shows a computer system 100 comprising: a computer processor 102 with mass storage devices 104, a graphical/textural display device 106, a keyboard 108, a pointing device 110 and a graphical/textual output device 112. The pointing device 110 may be a mouse, digitizing tablet, trackball, joystick, or any other similar cursor positioning device. The graphical output device 112 is used for generating hard copy of forms layout and for filling in forms.

FIG. 3A shows a software sub-routine 120 for controlling the computer system 100 (FIG. 2) to layout forms and ensure the aforementioned offset between clear areas for filling in variable information on the front and the back of the form. This subroutine is intended to be incorporated into existing or newly-created routines for laying out forms. It implementation in such programs is well within the grasp of one skilled in the art to which the present invention most nearly pertains. The sub-routine is entered at a step 122. In a first step 124, the subroutine "looks" at the front side (Side 1) of the form being designed, and specifically notes the coordinates of the clear areas where variable information is to be entered by the end-user of the form on the front side of the form. This is readily achieved by mapping the coordinates of the clear areas (e.g., the area 38 on the front of the original page 16 in FIG. 1) and storing the map in memory. Next, in a step 126, the subroutine looks at the clear areas for entering variable information on the back side of the form (e.g., the area 40 on the original page 16 in FIG. 1). The coordinates of these clear areas on the back of the form are preferably determined in the frame of reference of the front of the page, as though the system were looking through the page. Next, in a step 128 it is determined whether there is any conflict, i.e. front-to-back registration between the clear areas on the front of the page and the clear areas on the back of the page. If there is no conflict, the clear areas are by definition "offset", and the positive ("Y") result of the step 128 lead st the exit step 130 of the subroutine.

If the clear areas are not offset, as indicated by the negative ("N") result of the test 128, the non-offset portions of the clear areas in "conflict" (non-offset) are determined. These are the portions of the clear areas on the front and the back of the page that have the same coordinates (in the frame of reference of the front of the page). Conveniently, the clear areas for entering information on the front and the back of the page are shown on the display device 106 (FIG. 2), superimposed (as though looking through the page), as illustrated in FIGS. 4–10. The areas of "conflict", or superposition, are readily displayed on the display device 106 by differential shading, highlighting or coloring, depending on the type of display device employed.

FIG. 3B shows such a superimposed display of the original page 16 of FIG. 4, wherein a portion 150 of the clear area 38 conflicts with the a portion 150 of the clear area 40. The conflicting (non-offset) portion of the clear areas 38 and 40 is shown as shaded in FIG. 3B, but may be highlighted in any suitable manner.

In the case of such a conflict, various corrective actions may be taken by the forms designer. For instance, with the pointing device 110 (FIG. 2), one or both of the clear areas (e.g., 38 and 40) could be resized or moved. These techniques for modifying graphic icons are well known. The step of taking corrective actions is shown as step 134 in the sub-routine 120.

As mentioned hereinbefore, the methodology of examining the front and back of a form to ensure that there exists the required offset in the clear areas for the user entering variable information is readily integrated into a forms design package, the output of which is a layout for the form, which may be in machine readable format for use with automated machinery.

In the context of filling out variable information on the clear areas of the forms, the computer system 100 would be programmed with appropriate software which has been modified to ensure that the variable information is offset from front-to-back on the form, in the same manner that the laying out software (FIG. 3A) ensured that the clear areas were designed to be offset. There are many off the shelf software programs in use for filling out preprinted forms. In some cases, the software prints the fixed information as well as the variable information. These programs would require modification, according to the teachings of the present invention, to ensure that the variable information is offset, and preferably would display any "conflicts" (overlap of variable information) as noted above. In the case of filling out an already folded (see FIGS. 1D and 1E) completely blank form (no preprinted information), it would also be important that the preprinted information is offset.

FIGS. 4–10

FIGS. 4–10 show various configurations of "clear" areas for entering variable (user-entered, versus preprinted fixed) information on the two sides of a two-sided form.

FIG. 4 is essentially a review of the form 10 of FIGS. 1A–1E, and sets the scenario for the applicability of the present invention to two-sided carbonless forms. FIGS. 5–10 show alternate configurations of the layout of the clear areas for entering variable information on the form. It is unnecessary to further discuss the application of the carbonless coatings to these exemplary forms that will effect the making of a two-sided copy from a two-sided original.

FIG. 4 shows the original page 16 of the form 10 of FIGS. 1A–1E. As noted hereinbefore, the front side 12 of the original page 16 has a specific clear area 38 for entering first information on the front of the page, and the back side 14 of the original page 16 has a specific clear area 40 (shown in dashed lines) for entering second information on the back side 14 of the original page 16. Noticeably, in the view of FIG. 4, which is a view looking "through" a typical 8½ by 11 inch page, the clear areas 38 and 40 are offset from front-to-back on the original page, for reasons mentioned hereinbefore. In this embodiment, the clear area 38 is in the form of an inverted and backwards "L", having a horizontal portion 38*a* running along the top portion of the page and a vertical portion 38*b* running along the right side of the page (as viewed in the Figure). The clear area 40 is in the form of an "L" (as viewed in the Figure "through" the front of the page), having a vertical portion 40*a* running along the left side of the page (viewed through the front of the page) and a horizontal portion 40*b* running along the bottom of the page. This is a typical format for many forms. Notably, user-identifyinq, variable information is typically entered (e.g., by writing or typing) across the top front of the page, in the horizontal portion 38*a* of the area 38, and other variable information is entered along the right front side of the page, in the vertical portion 38*b* of the area 38. When the page is flipped over, for entering information on the back side thereof, further variable information is entered along the right back side of the page (left side, when viewed through the front in the Figure), in the vertical portion 40*a* of the area 40, and the user's signature and date would typically be entered along the bottom of the back of the page, in the horizontal portion 40*b* of the area 40.

FIG. 5 shows an alternate embodiment of the original page, herein labelled 516. A clear area on the front side 512 of the original page 516 is delineated by a border 538. An offset, clear area on the back side 514 of the page 516 is delineated by a border 540 (dashed lines). Throughout the embodiments, it is noted that the borders delineating the clear areas do not need to be visible.

In this embodiment, the clear area 538 on the front side 512 of the page 516 occupies substantially the right (as viewed) half of the page 516. The clear area 540 on the back side 514 of the page 516 occupies substantially the left (viewed through the page) half of the page 516, and is offset from the clear area 538. Together, the clear areas 538 and 540 account for nearly the full surface area of (one side of) the page. As noted hereinbefore, the remaining surface area of the front and back sides of the page may contain "fixed", or preprinted, information. In this manner, the entire front and back surfaces of the page can be used, in aggregate, for fixed and variable information. This feature is evident in the embodiments of FIGS. 5–10.

FIG. 6 shows an alternate embodiment of the original page, herein labelled 616. A clear area on the front side 612 of the page 616 is delineated by a border 638. An offset, clear area on the back side 614 of the page 616 is delineated by a border 640 (dashed lines).

In this embodiment, the clear area 638 on the front side 612 of the page 616 occupies substantially the top (as viewed) half of the page 616. The clear area 640 on the back side 614 of the page 616 occupies substantially the bottom (viewed through the page) half of the page 616, and is offset from the clear area 638. Together, the clear areas 638 and 640 account for nearly the full surface area (again, of the measure of one side) of the page.

FIG. 7 shows an alternate embodiment of the original page, herein labelled 716. A clear area on the front side 712 of the page 716 is delineated by a border 738. An offset, clear area on the back side 714 of the page 716 is delineated by a border 740 (dashed lines).

In this embodiment, the clear area 738 on the front side 712 of the page 716 has a portion 738*a* extending across the top (as viewed) of the page 716, a portion 738*b* extending along the right of the page, and a portion 738*c* extending along the bottom of the page. these three portions 738*a*, 738*b* and 738*c* form a backwards "C" (as viewed in the Figure). The clear area 740 on the back side 714 of the page 716 occupies substantially the remaining (offset from the area 738) area of the page, forming a rectangular area extending in from the left edge (as viewed through the Figure) of the page.

FIG. 8 shows an alternate embodiment of the original page, herein labelled 816. A clear area on the front side 812 of the page 816 is delineated by a border 838. An offset, clear area on the back side 814 of the page 816 is delineated by a border 840 (dashed lines).

In this embodiment, the clear area 838 on the front side 812 of the page 816 has a portion 838*a* extending along the right side of the page, and a portion 838*b* extending most, but not all, of the way down the middle of the page from the top edge of the page. The portion 838*b* is contiguous, but not coextensive, with the portion 838*a*. The clear area 840 on the back side 814 of the page 816 has a portion 840*a* extending along the left (as viewed through the page) side of the page 816 and a contiguous portion 840*b* extending along the bottom (viewed through the page) of the page from the left edge thereof most, but not all, of the way to the right edge of the page, without encroaching upon the area 838.

FIG. 9 shows an alternate embodiment of the original page, herein labelled 916. A series of clear areas on the front side 912 of the page 916 is delineated by a series of borders 938. A series of offset, clear areas on the back side 914 of the page 916 is delineated by a series of borders 940.

In this embodiment, the clear areas 938 on the front side 912 of the page 916 are a number of spaced-apart, horizontal "stripes" across the page (left-to-right, as viewed in the Figure). The clear areas 940 on the back side 914 of the page 916 are a corresponding number of offset, spaced-apart, horizontal stripes across the page, interleaved with the clear areas 938 on the front of the page. By way of example, the series of front clear areas 938 begins at the top edge (as viewed in the Figure) of the page 916, and the series of back clear areas 940 begins at the bottom edge of the page. In this manner, the number of front and back clear areas is equal. However, they could vary from one another, and could be sized unequally.

It should be understood that the stripes themselves are not visible. They are merely elongated rectangular clear areas for entering user-variable information, as described above.

FIG. 10 shows an alternate embodiment of the original page, herein labelled 1016. A series of clear areas on the front side 1012 of the page 1016 is delineated by a series of borders 1038. A series of offset, clear areas on the back side 1014 of the page 1016 is delineated by a series of borders 1040.

In this embodiment, the clear areas 1038 on the front side 1012 of the page 1016 are a number of spaced-apart, vertical "stripes" running the length of the page (top-to-bottom, as viewed in the Figure). The clear areas 1040 on the back side 1014 of the page 1016 are a corresponding number of offset, spaced-apart, vertical stripes tunning the length of the page, interleaved with the clear areas 1038 on the front of the page. By way of example, the series of front clear areas 1038 begins at the right edge (as viewed in the Figure) of the page 1016, and the series of back clear areas 1040 begins at the left edge of the page (as viewed through the page). In this manner, the number of front and back clear areas is equal. However, they could vary from one another, and could be sized unequally.

It should be understood that the patterns for offsetting clear areas on the front and back sides of a page is not limited to the specific embodiments of FIGS. 4–10, and that various elements of those configurations could be combined to create virtually unlimited offset patterns of clear areas for entering user-variable information which fulfill the objects of this invention.

It should further be understood that the configurations of offset clear areas for entering variable information on the two sides of a two-sided form are not limited to the form embodiment of FIGS. 1A–1C. Nor are they limited to any specific embodiment of the carbonless coating techniques disclosed in the aforementioned U.S. patent application No. 436,189. For example, there is disclosed in the aforementioned U.S. patent application No. 436,189 an embodiment of a two-sided, self-replicating form wherein the original page is not coated on either side, and the copy page has a Self-Contained ("SC") carbonless coating for replicating information entered in specific areas on the original page. (See FIGS. 1L–1M, therein.) These specific areas for entering variable information on the original page correspond to the "clear" areas mentioned above.

It should further be understood that with the folding technique shown in FIGS. 1D and 1E, variable information entered on the front (Side 1) of the original page is reproduced on the back (Side of the copy page, and vice-versa. However, the invention is not limited to this feature.

What is claimed is:

1. Carbonless copy paper, consisting essentially of:

a single sheet of paper having a front surface and a back surface and delineated into two panels, an original panel and a copy panel;

carbonless CB treatment applied to the front and back surfaces of the original panel; and carbonless CF treatment applied to the front and back surfaces of the copy panel;

wherein:

the carbonless CB treatment is applied to a first selected area on the front surface of the original panel;

the carbonless CF treatment is applied to a second selected area on the back surface of the original panel; and the first and second selected areas are offset front-to-back on the original panel;

further, comprising:

a first filling-in area on the front surface of the original panel for filling in first information, said first filling-in area corresponding to the second selected carbonless area on the back surface of the original panel; and a second filling-in area on the back surface of the original panel for filling in second information, said second filling-in area corresponding to the first selected carbonless area on the front surface of the original panel.

2. Carbonless copy paper, according to claim 1, wherein:

the carbonless CF treatment is applied to a third selected area on the front surface of the copy panel;

the carbonless CF treatment is applied to a fourth selected area on the back surface of the copy panel; and the third and fourth selected areas are offset front-to-back on the copy panel.

3. Carbonless copy paper, according to claim 1, wherein:

a fold delineates the single sheet into the original panel and the copy panel.

4. Carbonless copy paper, according to claim 1, wherein:

a line of perforations delineates the single sheet into the original panel and the copy panel.

5. Carbonless copy paper, according to claim 1, wherein:

the first and second filling-in areas, in aggregate, cover a total area on the front and back surfaces of the original panel corresponding substantially to the entire surface area on one surface of the original panel.

6. Carbonless copy paper, according to claim 1, wherein:

the first filling-in area is in the shape of an "L", with a horizontal portion extending across a top portion of front surface of the original panel and a vertical portion extending along a right side portion of the front surface of the original panel and the second filling-in area is in the shape of an "L", with a horizontal portion extending along a bottom portion of the back surface of the original panel and a vertical portion extending along a right side portion of the back surface of the original panel which right side portion of the back surface of the original page corresponds to a left side portion of the front surface of the original panel.

7. Carbonless copy paper, according to claim 1, wherein:

the first filling-in area covers approximately a right half portion of the front surface of the original panel; and the second filling-in area covers approximately a right half portion of the back surface of the original panel, which right half portion of the back surface of the original panel corresponds to a left half portion on the front surface of the original panel.

8. Carbonless copy paper, according to claim 1, wherein:

the first filling-in area covers approximately a top half portion of the front surface of the original panel; and the second filling-in area covers approximately a bottom half portion of the back surface of the original panel.

9. Carbonless copy paper, according to claim 1, wherein:

the first filling-in area includes a first portion extending along a top portion of the front surface of the original panel, a second portion extending along a right portion of the front surface of the original panel and a third portion extending along a bottom portion of the front surface of the original panel; and the second filling-in area is located in a middle right portion of the back surface of the original panel, which middle right portion of the back surface of the original panel corresponds to a middle left portion of the front surface of the original panel.

10. Carbonless copy paper, according to claim 1, wherein:

the first filling-in area includes a first portion extending along a right portion of the front surface of the original panel and a second portion located in a middle portion of the front surface of the original panel, said middle portion extending substantially from a top edge of the original panel most of the way towards a bottom edge of the original panel;

the second filling-in area includes a first portion extending along a right portion of the back surface of the original panel, which right portion of the back surface of the original panel corresponds to a left portion of the front surface of the original panel, and a second portion located in a bottom middle portion of the back surface of the original panel, which back middle portion of the back surface of the original panel corresponds to a front middle portion of the front surface of the original panel.

11. Carbonless copy paper, according to claim 1, wherein:

the first filling-in area includes a first number of vertically spaced-apart, horizontally extending, first stripe-like areas, each first stripe-like area extending substantially from a left edge to a right edge of the front surface of the original panel;

the second filling-in area includes a second number of vertically spaced-apart, horizontally extending, second stripe-like areas, each first stripe-like area extending substantially from a left edge to a right edge of the back surface of the original panel; and said second stripe-like areas are interleaved, from a top edge to a bottom edge of the original panel with said first stripe-like areas.

12. Carbonless copy paper, according to claim 1, wherein:

the filling-in area includes a first number of horizontally spaced-apart, vertically extending, first stripe-like areas, each first stripe-like area extending substantially from a top edge to a bottom edge of the front surface of the original panel;

the second filling-in area includes a second number of horizontally spaced-apart, vertically extending, second stripe-like areas, each first stripe-like area extending substantially from a top edge to a bottom edge of the back surface of the original panel; and said second stripe-like areas are interleaved, from a right edge to a left edge of the original panel with said first stripe-like areas.

* * * * *

UNITED STATES PATENT AND TRADEMARK OFFICE

CERTIFICATE OF CORRECTION

PATENT NO. : 5,137,494

DATED : 08/11/92

INVENTOR(S) : Schubert et al.

It is certified that error appears in the above-identified patent and that said Letters Patent is hereby corrected as shown below:

Col. 10, line 12, "CF" should read --CB--.

Signed and Sealed this

Twenty-eighth Day of September, 1993

*Attest:*

*Attesting Officer*

BRUCE LEHMAN

*Commissioner of Patents and Trademarks*